United States Patent [19]

Kerkhof et al.

[11] Patent Number: 4,998,037

[45] Date of Patent: Mar. 5, 1991

[54] ELECTRON TUBE HAVING ELECTRODE AND INSULATOR COMPONENTS WITH MATCHED COEFFICIENTS OF EXPANSION

[75] Inventors: Klaas W. Kerkhof; Cornelis Boutsma; Werner D. P. Kauwenberg, all of Eindhoven, Netherlands

[73] Assignee: U.S. Philips Corporation, New York, N.Y.

[21] Appl. No.: 368,443

[22] Filed: Jun. 19, 1989

[30] Foreign Application Priority Data

Jun. 30, 1988 [NL] Netherlands ..... 8801657

[51] Int. Cl.[5] ..... H01J 43/22

[52] U.S. Cl. ..... 313/103 CM; 313/105 CM

[58] Field of Search ..... 313/103 CM, 105 CM, 313/399, 534, 456, 482, 268, 292

[56] References Cited

U.S. PATENT DOCUMENTS 3,243,642 3/1966 Gebel ..... 313/103 CM X

FOREIGN PATENT DOCUMENTS 0006651 1/1980 European Pat. Off. .

147347 11/1981 Japan .

*Primary Examiner*—Kenneth Wieder

*Attorney, Agent, or Firm*—Robert J. Kraus

[57] ABSTRACT

An electron tube comprising a stack of at least one perforate plate-shaped insulating element and at least one perforate plate-shaped metal electrode structure, the insulating element comprising a core and being provided with an aluminium layer at least on a side facing the electrode structure, at least the outer layer of the aluminium layer being oxidized, and the coefficients of thermal expansion of the core and the electrode structure being at least substantially equal. In this manner, the thermal stresses occurring between the insulating element and the electrode structure during firing are reduced, so that the risk of their displacement relative to each other is reduced.

14 Claims, 3 Drawing Sheets

ELECTRON TUBE HAVING ELECTRODE AND INSULATOR COMPONENTS WITH MATCHED COEFFICIENTS OF EXPANSION

BACKGROUND OF THE INVENTION

The invention relates to an electron tube comprising a stack of at least one perforate plate-shaped insulating element and at least one perforate plate-shaped metal electrode structure, which are interconnected.

Such electron tubes can be used, inter alia, for television sets, night viewing and photodetection equipment.

An electron tube of the type described in the opening paragraph is known from European Patent Application EP No. 0 006 651 in which a description is given of an electron tube comprising an electron multiplier comprising a stack of plate-shaped perforate steel electrode structures, called dynodes in the European Patent Application, and plate-shaped perforate insulating elements. The insulating elements are made of aluminium. Their surface is anodized and they ensure that the electrodes are arranged at regular distances from one another and in an electrically insulating manner. In this example, the perforations in the insulating elements and the dynodes are aligned.

To obtain a proper vacuum in an electron tube it is customary to subject parts to a temperature treatment, i.e., subject them to a firing treatment.

It has however been found that due to such a temperature treatment the insulating element and the metal electrode structure may be displaced relative to one another.

SUMMARY OF THE INVENTION

It is an object of the invention to provide an electron tube of the type described in the opening paragraph, which alleviates the above-described problem.

For this purpose, an electron tube according to the invention is characterized in that the insulating element comprises a core and is provided with an aluminium layer at least on a side facing the electrode structure, at least the outer layer of said aluminium layer being oxidized and the coefficients of thermal expansion of the core and the electrode structure being at least substantially equal.

The invention is based on the insight that the above problem is caused by thermal stresses between the insulating element and the electrode structure, which are caused by differences in thermal expansion.

In the electron tube according to the invention, the insulating element comprises a core having a coefficient of thermal expansion which is substantially equal to the coefficient of thermal expansion of the electrode structure. By virtue hereof, the difference in thermal expansion between the insulating element and the electrode structure is reduced. Aluminium can be provided and made to oxidize in a relatively simple manner. The oxidized outer layer serves as an insulating layer.

Preferably, the core is manufactured from the same metal as the electrode structure. By virtue hereof, thermal stresses are reduced to the extent possible.

A preferred embodiment of the electron tube according to the invention is characterized in that the core has a thickness which is at least four times that of the aluminium layer. The thermal expansion of the core then largely determines the thermal expansion of the insulating element.

Preferably, the aluminium layer is partly oxidized. The aluminium layer comprises a layer of aluminium metal between the core and the oxidized outer layer. Aluminium metal has a relatively low modulus of elasticity. By virtue of this layer of aluminium metal any stresses occurring between the core and the aluminium layer can be absorbed.

In an embodiment of the invention the electrode structure comprises a system of sub-electrodes.

If the electrode structure comprises a system of sub-electrodes, thermal stresses may not only cause the above problem but may additionally cause a change in the relative positions of the sub-electrodes, and, consequently, the invention is of particular importance.

In an embodiment of an electron tube according to the invention, the stack comprises at least a further metal electrode structure and the insulating element is arranged between and connected to both metal electrode structures. The thermal stresses may be substantial, and the invention is of great importance, in particular when the insulting element is arranged between two metal electrode structures and connected thereto.

In an embodiment, the electron tube comprises an electron-generating system, an electron-sensitive element for registering electrons, and an electron multiplier arranged between the electron-generating system and the electron-sensitive system, and the stack forms part of the electron multiplier.

In a further embodiment of the electron tube according to the invention, the electron tube comprises a display screen having a phosphor pattern in more than one colour, and the electrode structure has deflection electrodes for deflecting electrons towards the phosphor pattern. In this case, the use of the invention is of particular importance because the deflection electrodes have to be accurately positioned relative to one another, relative to the phosphor pattern and relative to further parts of the electron tube; as a result of relatively small deviations it is possible that deflected electrons do not properly impinge on a phosphor pattern which adversely affects quality of the image displayed and, in particular, the colour purity.

In yet another embodiment of the electron tube according to the invention, the electron tube comprises an electron-generating system, an electron-sensitive element for registering electrons, and a selection system which is arranged between the electron-generating system and the electron-sensitive element, and which is used to selectively pass electrons from the electron-generating system to the electron-sensitive element, the stack forming part of the selection system and the electrode structure comprising a system of strip-shaped selection electrodes. Within the scope of the invention, a plate-shaped electrode structure having apertures also includes a system of strip-shaped electrodes.

In a further embodiment of the electron tube according to the invention, the core is made from a conducting material and forms a common electrode for influencing electrons, on a side facing away from the electrode structure. The common electrode may, for example, be used to accelerate or focus electrons.

BRIEF DESCRIPTION OF THE DRAWING

The invention will be explained in greater detail by means of a few exemplary embodiments and with reference to the accompanying drawings, in which.

DESCRIPTION OF THE PREFERRED EMBODIMENTS

Figure 1:
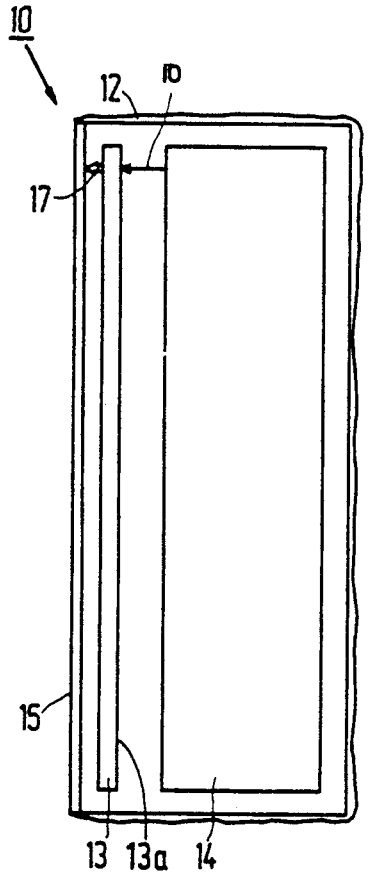
FIG. 1 is a sectional view of an electron tube.

The FIGS. are diagrammatic representations and they are not drawn to scale, corresponding parts of the various embodiments generally bearing the same reference numerals.

FIG. 1 is a diagrammatic sectional view of an electron tube 10 comprising an evacuated envelope 12 in which an electron multiplier or selection system 13, an electron-generating system 14 and an electron-sensitive element 15 are contained. An electron or electron beam 16 is incident on the electron multiplier or selection system 13 on an input side 13*a*. In an electron multiplier 13, the number of electrons is multiplied and an electron beam 17 having an increased intensity relative to the incoming electron beam 16, emerges on the output side of the electron multiplier 13. A selection system 13 selectively passes the electron or the electron beam. electron beam 17 impinges on the electron-sensitive element 15. The electron-generating system 14 and the electron-sensitive system 15 are shown diagrammatically. The actual shape of these systems depends on the type and purpose of the electron tube. The electron-generating system 14 may comprise, for example, a photocathode. Light which is incident on the photocathode induces an emission of electrons. These are incident, either directly or after acceleration and/or focussing, on the electron multiplier. In this manner, an optical image can be recorded. The electron-generating system may also comprise one or a system of hot cathodes for generating one or more electron beams and an electrode system for forming a two-dimensional electron beam intensity pattern on the electron multiplier. In this manner an image can be displayed. The electron-sensitive element can display the intensity of the incident electron beams, for example, in an optical image or in an electric image. An example of an electron-sensitive element which displays an optical image is a cathodoluminescing screen, an example of an electron-sensitive element which displays an electric image is a so-called CCD (Charged Coupled Device) matrix.

An important aspect for the operation of electron tubes is the quality of the vacuum. In general, the gas pressure in the electron tube must be as low as possible. A problem in this connection is that gas molecules are adsorbed at the surfaces, which gas molecules are desorbed from the surfaces during the life of the electron tube, so that the gas pressure in the electron tube increases. In general, this has a negative effect on the operation and the life of the electron tube. A measure to overcome this problem is the firing of parts, i.e., parts are heated to a high temperature so that gases present at the surfaces are desorbed. These gases are subsequently exhausted by pumping after which the tube is sealed. Firing may however lead to displacement of an electrode structure and an insulating element relative to one another.

Figure 2A:
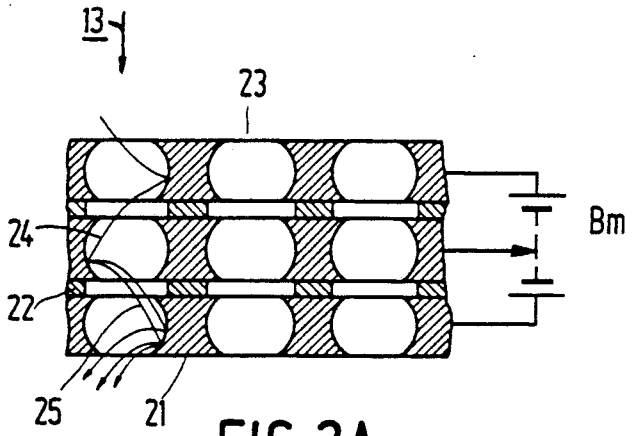
FIG. 2A PRIOR ART
FIG. 2*a* is a sectional view of an electron multiplier known from the present state of the art.
Figure 2B:
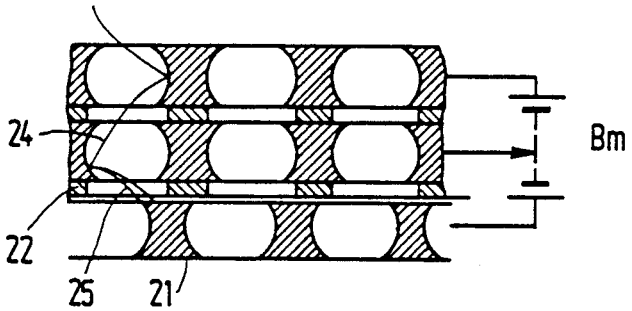
FIG. 2B PRIOR ART
FIG. 2*b* is a sectional view of the possible result of the separation of a dynode and an insulating element.

FIG. 2*a* is a sectional view of an electron multiplier 13 as described in EP No. 0 006 651. The multiplier is a so-called channel plate electron multiplier. It comprises a laminated structure having a stack of perforate steel dynodes 21 and perforate plate-shaped insulating elements 22, the perforations bearing reference numeral 23. In EP No. 0 006 651, the insulating elements are aluminium plates whose surfaces are anodized. The dynodes are provided with connections for applying voltages Bm. The operation of such an electron multiplier is diagrammatically shown in one of the perforations 23. An electron 24 is incident on a dynode 21. Several electrons 25 are then created. These electrons 25 are accelerated by an electric field which is present between the dynodes and are incident on the next dynode. Then, a further multiplication of the number of electrons takes place, which are also accelerated and impinge on the next dynode. For a proper operation of the electron multiplier it is important that the apertures in successive dynodes and insulating elements are properly arranged relative to each other. FIG. 2*b* shows an electron multiplier having a displaced dynode. Due to this, electrons 25 are captured by this dynode. This adversely affects the operation of the electron multiplier.

Figure 3:
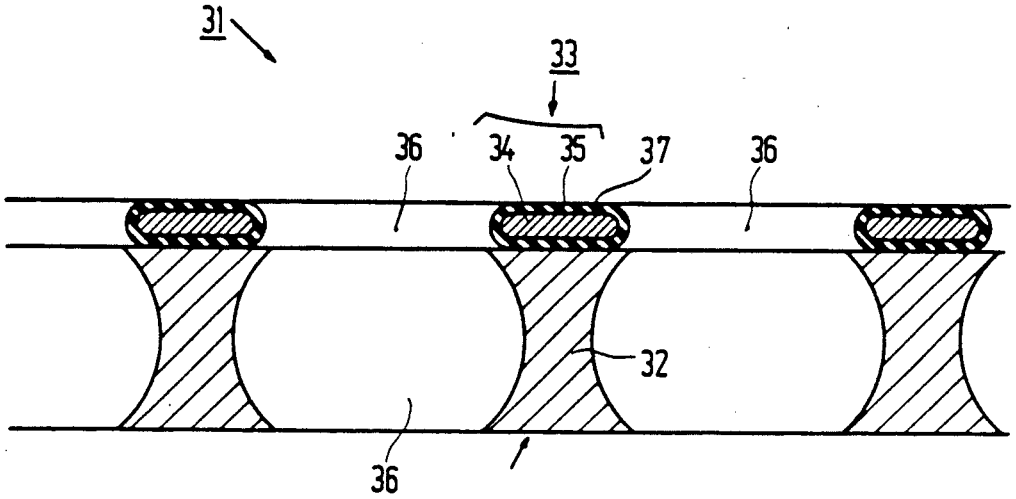
FIG. 3 is a sectional view of a detail of an electron multiplier which can suitably be used in a vacuum electron tube according to the invention.

FIG. 3 shows a detail of an electron multiplier which can suitably be used in an electron tube according to the invention. A stack 31 comprises a steel dynode 32 and an insulating element 33, which are fixedly secured to each other. Both parts 32 and 33 are provided with apertures 36. The insulating element 33 comprises a steel core 34 and an aluminium layer 35 having an oxidized outer layer 37. The difference between the coefficients of thermal expansion of the dynode and the insulating element is reduced, due to the fact that the insulating element has a steel core 34 consequently, the risk that the dynode and the insulating element become separated is also reduced. If an insulating element is connected to two dynodes the stresses occurring are larger. The invention is advantageous, in particular, under such conditions. A preferred embodiment is characterized in that the thickness of the core is at least four times the thickness of the outer cover. In this case, the coefficient of expansion of the insulating element is largely determined by the steel core.

Figure 4:
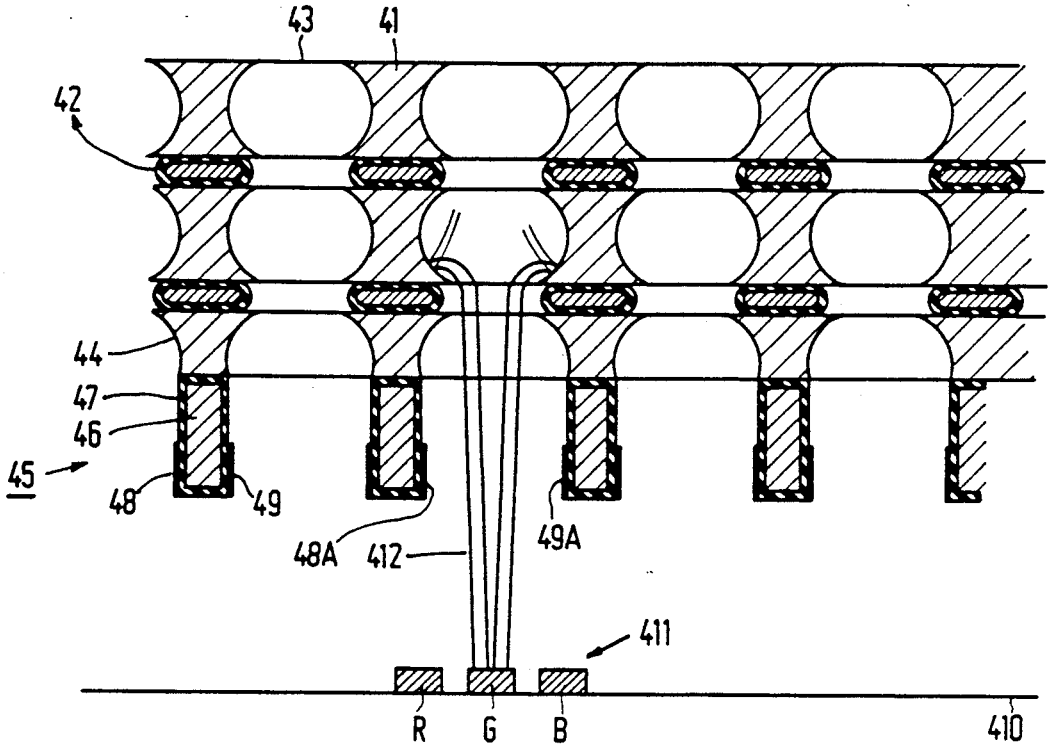
FIG. 4 is a sectional view of a detail of an electron multiplier which can suitably be used in a vacuum electron tube according to the invention, and which is provided with a stack of deflection electrodes.

It is advantageous, in particular, for an electron tube comprising a display screen having a phosphor pattern in more than one colour and an insulating element having deflection electrodes which is arranged in front of the display screen, if the insulating element comprises a core having a coefficient of expansion which is at least substantially equal to that of the deflection electrodes, the core and the deflection electrodes preferably being made of the same material, and a completely or preferably partly oxidized aluminium outer layer. An electron tube comprising an electron multiplier and an insulating element having deflection electrodes is known per se from British Patent Application GB No. 2,124,017. In the said British Patent Application, the insulating element comprises a glass plate in which elongated apertures are formed. A detail of an electron multiplier and an insulating element which can suitably be used in an electron tube according to the invention is shown in FIG. 4. The electron multiplier comprises dynodes 41 between which insulating elements 42 are arranged. Apertures 43 are formed in the dynodes and the insulating elements. The insulating elements 42 are preferably, but not necessarily, insulating elements as described above. The electron multiplier comprises a final dynode 44. An insulating element 45 is connected to this final dynode. This insulating element comprises deflection electrodes 48 and 49 and a core 46 of the same material as the deflection electrodes, and an oxidized aluminium layer 47. The electron multiplier is arranged in front of a display screen 410. This display screen 410 is provided with a phosphor pattern 411. Only one triad of this pattern is shown in FIG. 4. The electrons emerging from the apertures 43 can be deflected by energizing the deflection electrodes at suitable voltages. FIG. 4 shows a situation in which equal voltages are applied to the electrodes 48*a* and 49*a* which are located on both sides of the electron beam 412. Then the electron beam 412 is incident on the green phosphor G. The electron beam 412 can be deflected towards the red phosphor R by applying to positive voltage electrode 48*a* a and a negative voltage electrode 49*a*. The relative positions of the apertures 43 in the final dynode 44 and of the deflection electrodes 48 and 49 must meet very high requirements. A proper positioning of the insulating element 45 relative to the final dynode 44, of the deflection electrodes relative to the apertures in the insulating element, of the deflection electrodes relative to one another, and of the deflection electrodes relative to the phosphor pattern is important. Consequently, it is very important that during firing no displacement takes place of the deflection electrodes relative to the apertures in the final dynode or in the insulating element, or relative to each other. In an electron tube according to the invention, the insulating element on which the deflection electrodes are arranged, comprises a core of a material having the same coefficient of expansion as the deflection electrodes and, preferably, the core is made from the same metal as the deflection electrodes, and an oxidized aluminium layer. The aluminium oxide ensures a proper electrical insulation between the final dynode and the deflection electrodes, and the composition of the core ensures that the difference in thermal expansion between the final dynode and the insulating element is small. With respect to a carrier for deflection electrodes, as shown in GB No. 2,124,017, it is further observed that, if the insulating element is made of metal, a glass insulating element as described in GB No. 2,124,017 is much more vulnerable than a metal insulating element.

Figure 5:
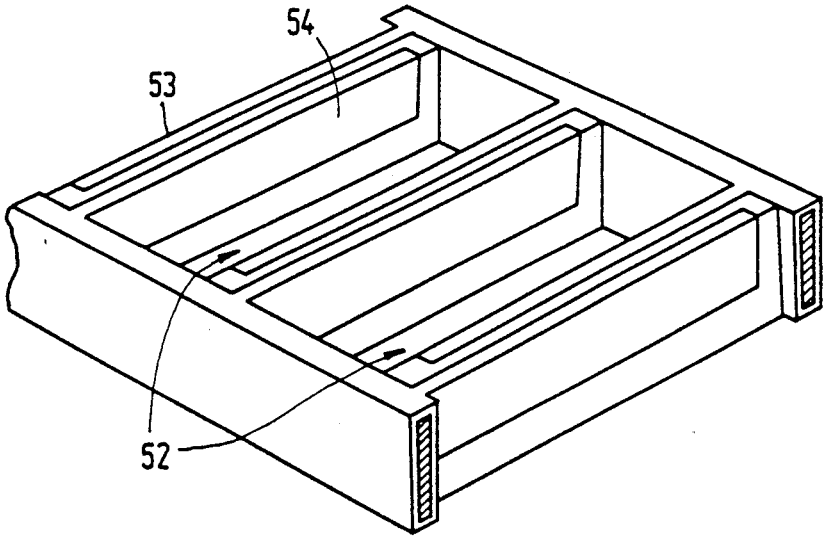
FIG. 5 is a partly perspective elevational view of a stack having deflection electrodes.

FIG. 5 is a partly perspective elevational view of an insulating element for use in an electron multiplier which can suitably be used in an electron tube according to the invention. An insulating element 51 is provided with elongated apertures 52 and deflection electrodes 53 and 54.

Figure 6A:
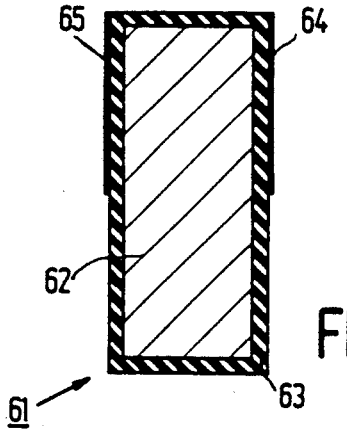
FIG. 6*a* and FIG. 6*b* are sectional views of a detail of two embodiments of a stack having deflection electrodes.
Figure 6B:
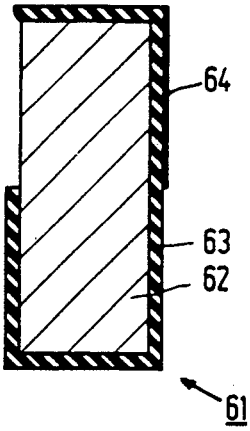

FIG. 6*a* is a sectional view of an insulating element having two deflection electrodes. In FIG. 6*a*, the insulating element 61 comprises a core 62, an outer layer 63 and two deflection electrodes 64 and 65. In FIG. 6*b*, one of the deflection electrodes has been omitted. The function of the deflection electrode 65 is taken over by the core of the insulating element itself. This has the advantage that the core is in general less easily damaged than a deflection electrode, so that the risk of failure is reduced.

Figure 7A:
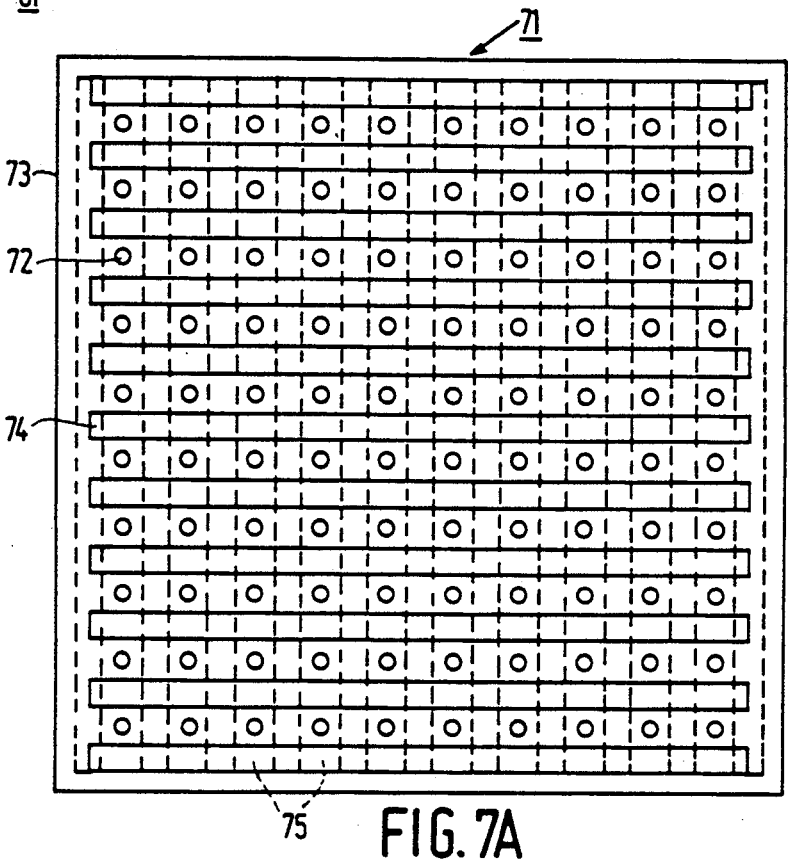
FIG. 7*a* and FIG. 7*b* are a top view and a sectional view, respectively, of a stack which is appropriate for use in a selection system suitable for use in an electron tube according to the invention.
Figure 7B:
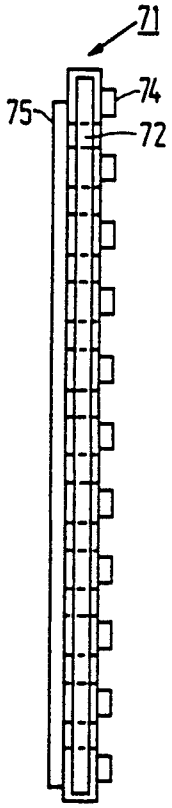

FIGS. 7*a* and 7*b* are a top view and a sectional view, respectively, of a stack which is appropriate for use in a selection system which can suitably be used in an electron tube according to the invention.

A stack 71 is provided with apertures 72 and comprises an insulating element 73 between electrode structures 74 and 75. The electrode structures 74 and 75 each comprise a system of sub-electrodes. By selectively energizing these sub-electrodes electric fields can be formed in the apertues 72, such that electrons can pass through only one or a number of apertures.

Figure 8:
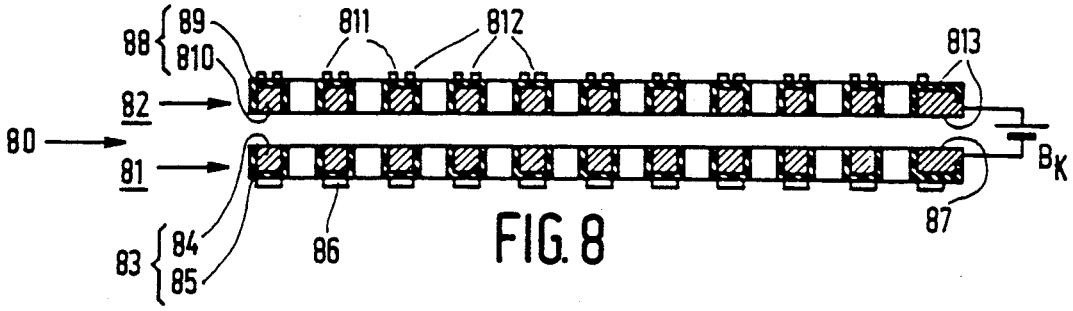
FIG. 8 shows two stacks in which the core of the insulating element forms a common electrode on a side facing away from the associated electrode structure.

FIG. 8 shows an assembly 80 of stacks 81 and 82. The stack 81 comprises an insulating element 83 having a core 84 and an oxidized aluminium layer 85 carrying selection electrodes 86. The core is uncovered on a side 87 facing away from the selection electrodes 86. The stack 82 comprises an insulating element 88 having a core 89 and an oxidized aluminium layer 810 carrying deflection electrodes 811 and 812. The core is uncovered on a side 813 facing away from the deflection electrodes 811 and 812. During operation, a voltage $B_k$ is applied between the cores 84 and 89. By virtue hereof, the electrons are focussed and accelerated between the cores.

A possible manner of manufacturing insulating elements which can suitably be used in a vacuum electron tube according to the invention is as follows: apertures are formed in a metal plate by means of etching. Subsequently, an aluminium layer is applied by means of an electrodeposition process. The thickness of the metal plate is, for example, approximately 150 μm, the thickness of the aluminium layer is 15 μm. Next, the aluminium layer is completely or partly oxidized, for example, in oxalic acid. Experiments have shown that an electrode structure provided on insulating elements manufactured as described above can be energized at high voltages without the occurrence of a breakdown.

Subsequently, the deflection electrodes can be provided, for example by means of vacuum evaporation, if the insulating element is to be used as a carrier for deflection electrodes.

It will be obvious that many variations are possible to those skilled in the art without departing from the scope of the invention.

We claim:

1. An electron tube comprising a stack of at least one plate-shaped insulating element having perforations and at least one plate-shaped non-aluminum metal electrode structure having perforations, which are interconnected with the perforations aligned, characterized in that the insulating element comprises a core and is provided with an aluminum layer, at least on a side facing the electrode structure, an outer sublayer of said aluminum layer being oxidized and the coefficients of thermal expansion of the core and the electrode structure being substantially equal.

2. An electron tube as claimed in claim 1, characterized in that the core is manufactured from the same metal as the electrode structure.

3. An electron tube as claimed in claim 1 or 2, characterized in that the thickness of the core is at least four times the thicknes of the aluminium layer.

4. An electron tube as claimed in claim 3, characterized in that the aluminium layer has a thickness of approximately 15 μm.

5. An electron tube as claimed in claim 1 or 2, characterized in that the aluminium layer is partly oxidized.

6. An electron tube as claimed in claim 1 or 2, characterized in that the electrode structure comprises a system of sub-electrodes.

7. An electron tube as claimed in claim 1 or 2, characterized in that the stack comprises at least a further metal electrode structure, and the insulating element is arranged between and connected to both metal electrode structures.

8. An electron tube as claimed in claim 1 or 2, characterized in that the electron tube comprises an electron-generating system, an electron-sensitive element for registering electrons, and an electron multiplier arranged between the electron-generating system and the electron-sensitive system, the stack forming part of the electron multiplier.

9. An electron tube as claimed in claim 6, characterized in that the electron tube comprises a display screen having a phosphor pattern in more than one colour, and the electrode structure comprises deflection electrodes for deflecting electrons towards the phosphor pattern.

10. An electron tube as claimed in claim 9, characterized in that the core forms a deflection electrode.

11. An electron tube as claimed in claim 6, characterized in that the electron tube comprises an electron-generating system, an electron-sensitive element for registering electrons, and a selection system arranged between the electron-generating system and the electron-sensitive element, which selection system selectively passes electrons from the electron-generating system to the electron-sensitive element, the stack forming a part of the selection system and the electrode structure comprising a system of strip-shaped sub-electrodes.

12. An electron tube as claimed in claim 6, characterized in that the core is manufactured from an electrically conductive material and forms a common electrode for influencing electrons, on a side facing away from the electrode structure.

13. A stack of plate-shaped members for inclusion in an electron tube, said stack comprising at least one plate-shaped insulating element having perforations and at least one plate-shaped non-aluminum metal electrode structure having perforations, which are interconnected with the perforations aligned, characterized in that the insulating element comprises a core and is provided with an aluminum layer, at least on a side facing the electrode structure, an outer sublayer of said aluminum layer being oxidized and the coefficients of thermal expansion of the core and the electrode structure being substantially equal.

14. A stack as in claim 13 comprising at least first and second ones of said metal electrode structure, the insulating element being arranged between and connected to both of said first and second metal electrode structures.

* * * * *